US009103623B2

(12) United States Patent
Giannelli et al.

(10) Patent No.: US 9,103,623 B2
(45) Date of Patent: Aug. 11, 2015

(54) CARTRIDGE GAS ENERGIZED GUN FOR ARROWS, DARTS AND THE LIKE

(71) Applicants: Chance Giannelli, Hope Mills, NC (US); John W. Kieckhefer, Prescott, AZ (US); Jacques A. Nevils, Fairview, TX (US); Harrison Tobin, Flower Mound, TX (US)

(72) Inventors: Chance Giannelli, Hope Mills, NC (US); John W. Kieckhefer, Prescott, AZ (US); Jacques A. Nevils, Fairview, TX (US); Harrison Tobin, Flower Mound, TX (US)

( * ) Notice: Subject to any disclaimer, the term of this patent is extended or adjusted under 35 U.S.C. 154(b) by 0 days.

(21) Appl. No.: 14/153,012

(22) Filed: Jan. 11, 2014

(65) Prior Publication Data

US 2015/0198407 A1 Jul. 16, 2015

(51) Int. Cl.

| | |
|---|---|
| ***F41B 11/85*** | (2013.01) |
| ***F41B 11/62*** | (2013.01) |
| ***F41B 11/83*** | (2013.01) |

(52) U.S. Cl.

CPC ..... *F41B 11/62* (2013.01); *F41B 11/83* (2013.01)

(58) Field of Classification Search

CPC ..... F41B 11/85; F41A 21/28; F41A 1/06

USPC ..... 124/76, 56, 61; 42/1.12, 106; 452/57

See application file for complete search history.

(56) References Cited

U.S. PATENT DOCUMENTS

| | | | | | |
|---|---|---|---|---|---|
| 2,348,337 | A | * | 5/1944 | Francis | 102/512 |
| 2,397,572 | A | * | 4/1946 | Weaver | 42/10 |
| 2,518,395 | A | * | 8/1950 | Sopris | 227/9 |
| 2,922,185 | A | * | 1/1960 | Aitken et al. | 42/1.12 |
| 3,067,454 | A | * | 12/1962 | Catlin et al. | 42/1.12 |
| 3,068,601 | A | * | 12/1962 | Arrowsmith | 42/1.12 |
| 3,346,981 | A | * | 10/1967 | Macdonald | 42/106 |
| 3,381,403 | A | * | 5/1968 | Murdoch | 42/106 |
| 3,727,337 | A | * | 4/1973 | Hancox | 42/1.12 |
| 3,745,682 | A | * | 7/1973 | Waldeisen | 42/106 |
| 3,895,454 | A | * | 7/1975 | Hancox | 42/1.12 |
| 4,086,682 | A | * | 5/1978 | Hancox | 42/1.12 |
| 4,467,544 | A | * | 8/1984 | Gerwig | 42/1.08 |
| 4,854,294 | A | * | 8/1989 | Lala | 124/62 |
| 5,529,300 | A | * | 6/1996 | Frazier et al. | 463/47.4 |
| 6,250,007 | B1 | * | 6/2001 | Payne et al. | 42/1.12 |
| 6,524,286 | B1 | * | 2/2003 | Helms et al. | 604/289 |
| 7,444,940 | B2 | * | 11/2008 | Kapeles et al. | 102/502 |
| D681,147 | S | * | 4/2013 | Barker et al. | D22/103 |
| D681,148 | S | * | 4/2013 | Wilkinson | D22/103 |
| 8,418,592 | B1 | * | 4/2013 | Gonstad et al. | 89/1.14 |
| 8,590,197 | B1 | * | 11/2013 | Sylvester | 42/16 |
| 8,701,325 | B1 | * | 4/2014 | Rayner | 42/76.01 |
| 2014/0109454 | A1 | * | 4/2014 | Rayner | 42/76.01 |

* cited by examiner

*Primary Examiner* — Michael David

(74) *Attorney, Agent, or Firm* — James L. Jackson

(57) ABSTRACT

A cartridge gas energized arrow gun has upper and lower receivers, with a cartridge receiving member having a cartridge chamber and a bolt locking receptacle secured to the upper receiver. An arrow supporting barrel is secured to the upper receiver and defines a chamber within which an arrow is located. Cartridge gas from a blank ammunition cartridge within the cartridge chamber is employed to propel the arrow from the barrel. A manually operated bolt and bolt carrier assembly is moveable within the upper receiver for blank cartridge handling during loading, firing, extraction and ejection of blank cartridges.

13 Claims, 4 Drawing Sheets

SECTION A-A

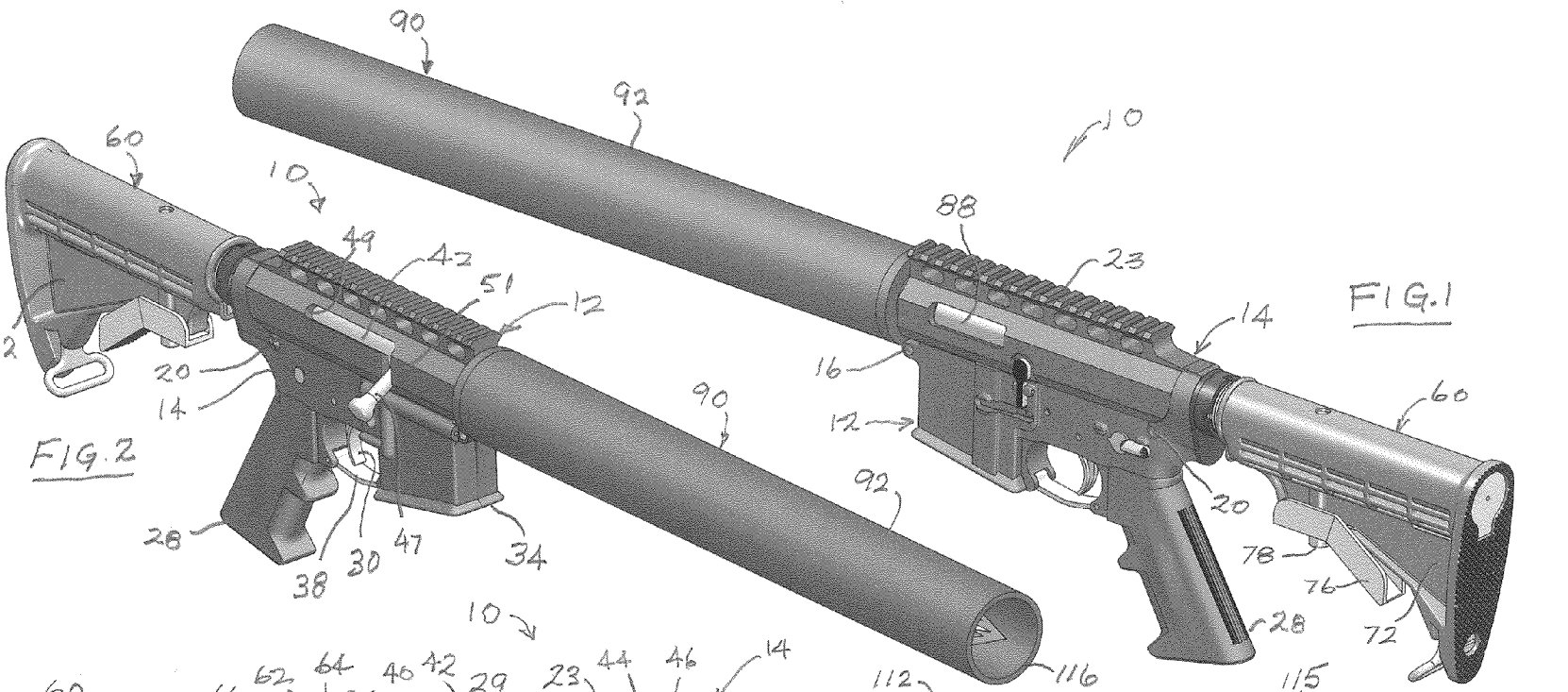
FIG. 1
FIG. 2
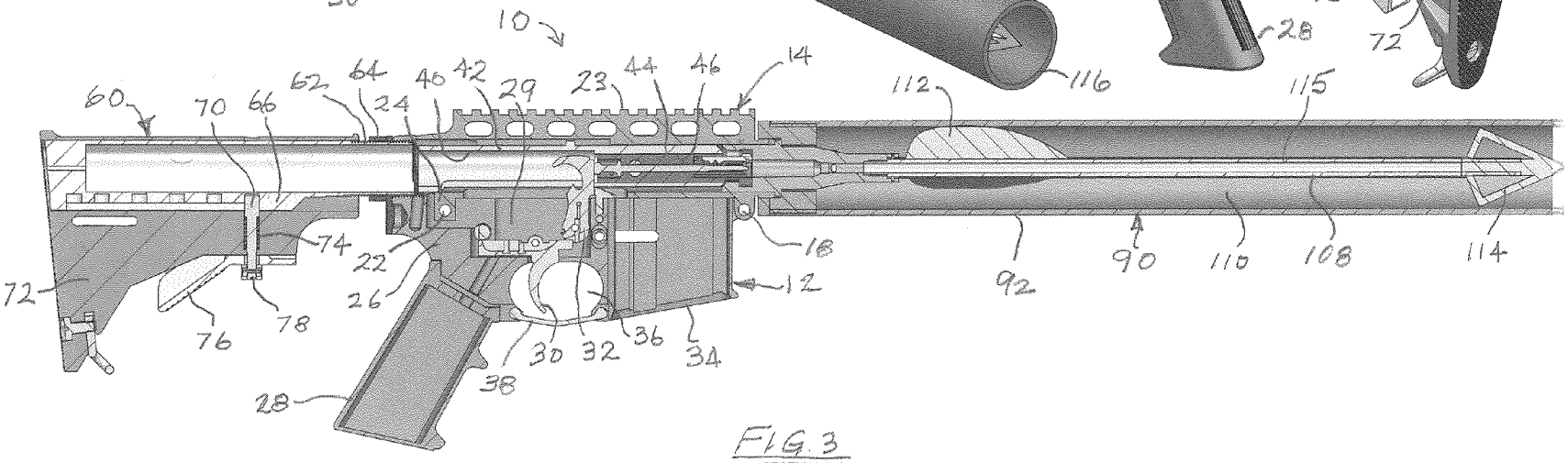
FIG. 3
SECTION A-A

CARTRIDGE GAS ENERGIZED GUN FOR ARROWS, DARTS AND THE LIKE

BACKGROUND OF THE INVENTION

1. Field of the Invention

The present invention relates generally to arms for firing projectiles and more particularly concerns arms having an upper firearm receiver which is detachably mounted to a lower firearm receiver that provides for accurate cartridge gas energized firing of arrows, darts or other projectiles. Even more specifically, the present invention concerns the use of standard blank rifle cartridges as the power source for propelling an arrow, dart or other projectiles from a barrel that provides for support and guidance thereof.

2. Description of the Prior Art

Early implements for hunting animals and for assault and defense activities is known as the bow and arrow which is still being manufactured and used at this time, mostly for sporting and competition, but also for animal hunting activities. As this technology has advanced, cross-bows, spring energized string operated arrow guns and stored gas energized arrow guns have been developed for propelling arrows, darts and bolts. Many of these arrow gun devices are being manufactured and used at the present time, typically for hunting. Target shooting and other sporting activities.

More recently, devices for propelling arrows, bolts and the like have taken the form of air or other gas operated devices, wherein the gas it typically developed by manually operation of a pumping mechanism or is supplied by a gas pressurized cartridge. It is desirable therefore to provide a gas operated gun type mechanism, wherein the gas for propulsion of arrows, darts, bolts and the like from a gun is provided by discharge of a power containing blank firearm cartridge. For purposes of the present invention, the terms "arrow" and "projectile" is deemed to include a wide variety of projectiles, including arrows, darts, bolts and virtually any kind of device that can be propelled from the barrel of a gun-like mechanism by the energy of cartridge gas that is developed by the combustion of a material such as gunpowder or any other suitable gas generating material.

SUMMARY OF THE INVENTION

It is a principal feature of the present invention to provide a novel cartridge gas energized gun that employs pivotally connected upper and lower receivers that have many of the attributes of and AR-15 type tactical firearm and wherein the upper receiver is adapted for discharging a blank ammunition cartridge for cartridge gas generation and employs a barrel that is adapted for support, propulsion and guidance of a projectile such as an arrow.

It is another feature of the present invention to provide a novel cartridge gas energized gun that employs a wide range of blank cartridges, such as rim-fire cartridges, center-fire cartridges having cartridge cases and non-cased combustion gas generating devices for propulsion of arrows and other projectiles.

It is also a feature of the present invention to provide a novel cartridge gas energized arrow gun that is of bolt-action character having a manually actuated locking bolt with a bolt actuating lever on one side of the upper receiver of the gun and a cartridge case ejection port located on the opposite side of the upper receiver.

Briefly, the various objects and features of the present invention are realized through the provision of a cartridge gas energized arrow gun having upper and lower receivers that have the substantial form of the upper and lower receivers of a conventional AR-15 type tactical rifle. The upper receiver is adapted for bolt action type loading, firing and ejection of blank ammunition cartridges for cartridge gas generation. A bolt carrier and bolt are located within the upper receiver and are moveable to a locked condition wherein a triangular bolt head with locking lugs is engaged within a bolt head receptacle of a cartridge receiving member that is secured to the upper receiver.

The bolt member is manually actuated and is provided with a bolt lever that is located on one side, preferably the right side, of the upper receiver. The upper receiver is provided with a bolt lever slot that permits rotational movement of the bolt toward its locked and unlocked positions and permits manually operated linear movement of the bolt for cartridge retrieving from a cartridge magazine and for cartridge extraction and ejection. The upper receiver is also provided with an ejection port on one side, preferably the left side of the upper receiver.

A barrel member having a barrel retaining nut is threaded onto a barrel mount of the upper receiver and the barrel nut serves to secure a cartridge receiving member to the barrel mount of the upper receiver. The cartridge receiving member defines a cartridge chamber within which is cartridge is received and defines a gas passage extending forward from the cartridge chamber. A retainer pin or other retainer device is welded or otherwise positively secured in place to prevent removal of the cartridge receiving member and barrel according to presently existing ATF rules. The barrel member is of tubular form and is of sufficiently large diameter to contain the fletching of an arrow that is located within the barrel and to contain an arrow head of the arrow. The forward end portion of the cartridge receiving member is also formed to define an arrow shaft receptacle within which a rear portion of an arrow shaft is received. The gas passage of the cartridge receiving member is also in communication with the arrow shaft receptacle, so that the force of cartridge gas pressure is applied to the rear portion of the arrow shaft to propel it from the barrel.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration showing the top and left side portions of a cartridge gas energized arrow projecting firearm that is constructed according to the principles of the present invention;

FIG. 2 is an isometric illustration showing the top and right side portions of the cartridge gas energized arrow projecting firearm of FIG. 1;

FIG. 3 is a longitudinal section view of the cartridge gas energized arrow projecting firearm of FIGS. 1 and 2;

FIG. 4 is an enlarged longitudinal section view showing the forward portions of the upper and lower receivers and showing the rear end portion of the barrel and barrel mount assembly of FIG. 3;

FIG. 5 is an exploded isometric illustration, particularly emphasizing the relationships of the mechanical components of the upper receiver portion of the cartridge gas energized arrow projecting firearm of FIGS. 1 and 2; and FIG. 6 is an exploded isometric illustration showing the upper receiver and receiver components of the cartridge gas energized arrow projecting firearm of FIGS. 1-4.

DETAILED DESCRIPTION OF PREFERRED EMBODIMENT

Figure 4:
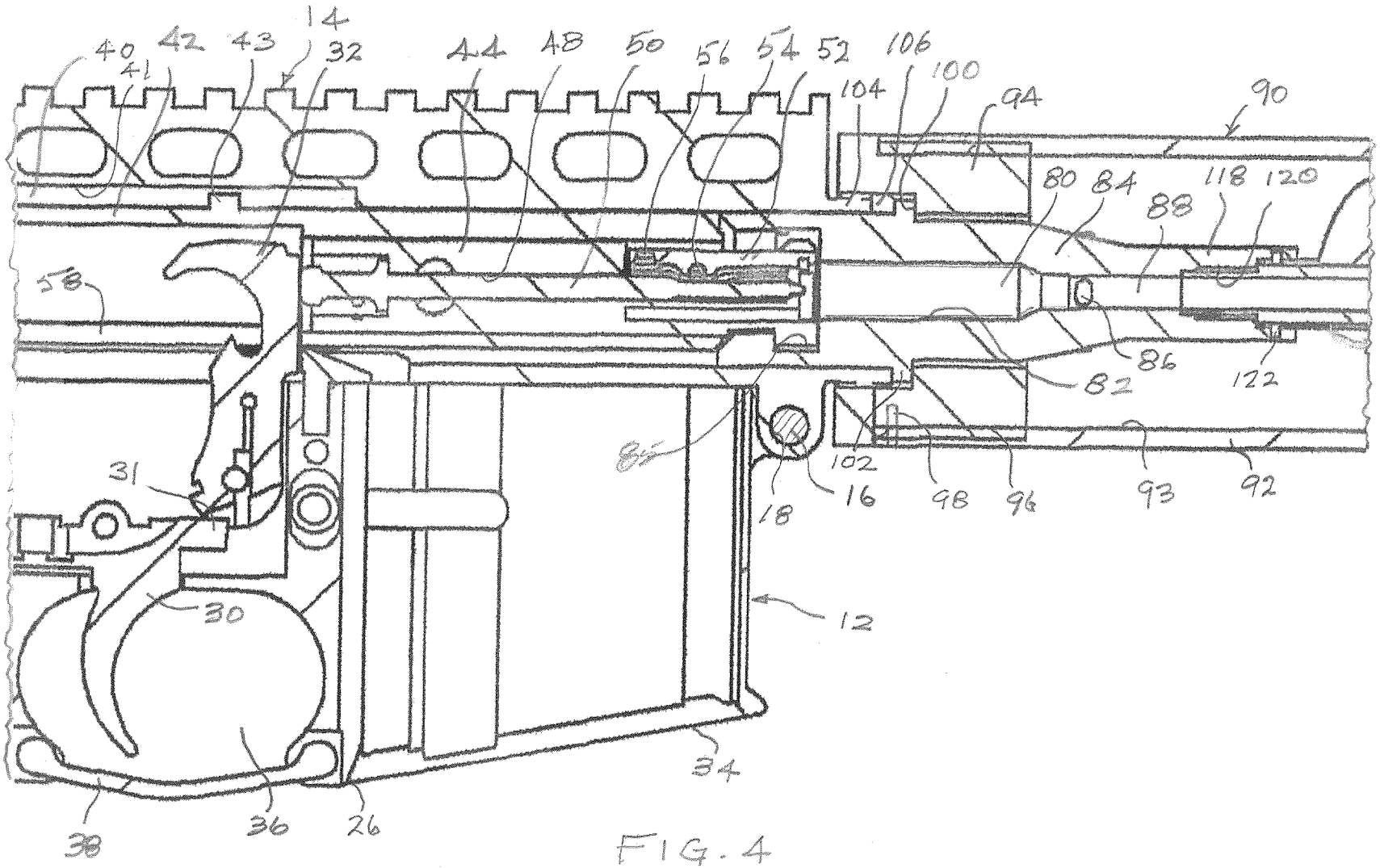

Referring now to the drawings and first to FIGS. 1-3 and 6, an arrow or bolt projecting firearm embodying the principles of the present invention is shown generally at 10, having a lower receiver mechanism shown generally at 12 and an upper receiver mechanism that is shown generally at 14. The lower receiver mechanism is of substantially conventional character, such as having many of the features of a tactical firearm, such as the AR-15, semi-automatic rifle. However, it should be noted that the firearm of the present invention has a mechanism that is not adapted for semi-automatic cartridge cycling.

The upper receiver mechanism 12 is pivotally mounted to the lower receiver mechanism by a pivot pin 16 that is received by pivot pin openings 18 of the upper and lower receivers in the same manner as the upper and lower receivers of a conventional AR-15, semi-automatic rifle are pivotally mounted. When the upper and lower receivers are located at their closed positions, they are locked against pivotal movement by a locking pin 20 that is received within locking pin openings 22 of the lower receiver and a locking tab 24 that projects downwardly from the rear portion of the upper receiver. The upper receiver is preferably provided with an accessory mount rail 23 that enables various types of sighting devices and other accessories to be mounted to the upper receiver.

The lower receiver mechanism 12 has a lower receiver frame 26, as shown in FIGS. 3 and 4 defining a hand-grip 28 and having an internal cavity 29 within which a trigger 30 and hammer assembly 32 are mounted for movement. The trigger 30 is a component of a trigger assembly 31 for releasing the hammer and permitting it to be rotated about its pivot by a hammer spring. The lower receiver frame 26 also defines a magazine receptacle 34 which is adapted to receive a cartridge magazine containing a number of blank ammunition cartridges that are selectively fired for generation of combustion gas. A trigger opening 36 is defined by the lower receiver frame 26 and a trigger guard member 38 is secured to the frame in the usual fashion for firearms. A safety member is provided for the trigger mechanism to permit the arrow gun to be rendered safe even when a cartridge is present within the cartridge chamber and the hammer is at its cocked position. This feature is conventional to virtually all AR-15 type firearms.

With reference to FIG. 4, the upper receiver mechanism 14 has an internal chamber 40 within which is moveable a bolt carrier 42. The bolt carrier 42 has an upwardly projecting guide member 43 that is disposed for engagement within an internal guide slot 41 to limit its forward linear movement within the internal chamber 40. A bolt member 44 is located for linear and rotational movement within a chamber 46 of the bolt carrier 42 and has an internal passage 48 within which a firing pin 50 is movably contained. A cartridge extractor 52 is pivotally mounted to the bolt member 44 by a pivot mount 54 and is energized to a position gripping the rear recess or base of a cartridge case by the force of an extractor spring member 56.

Figure 5:
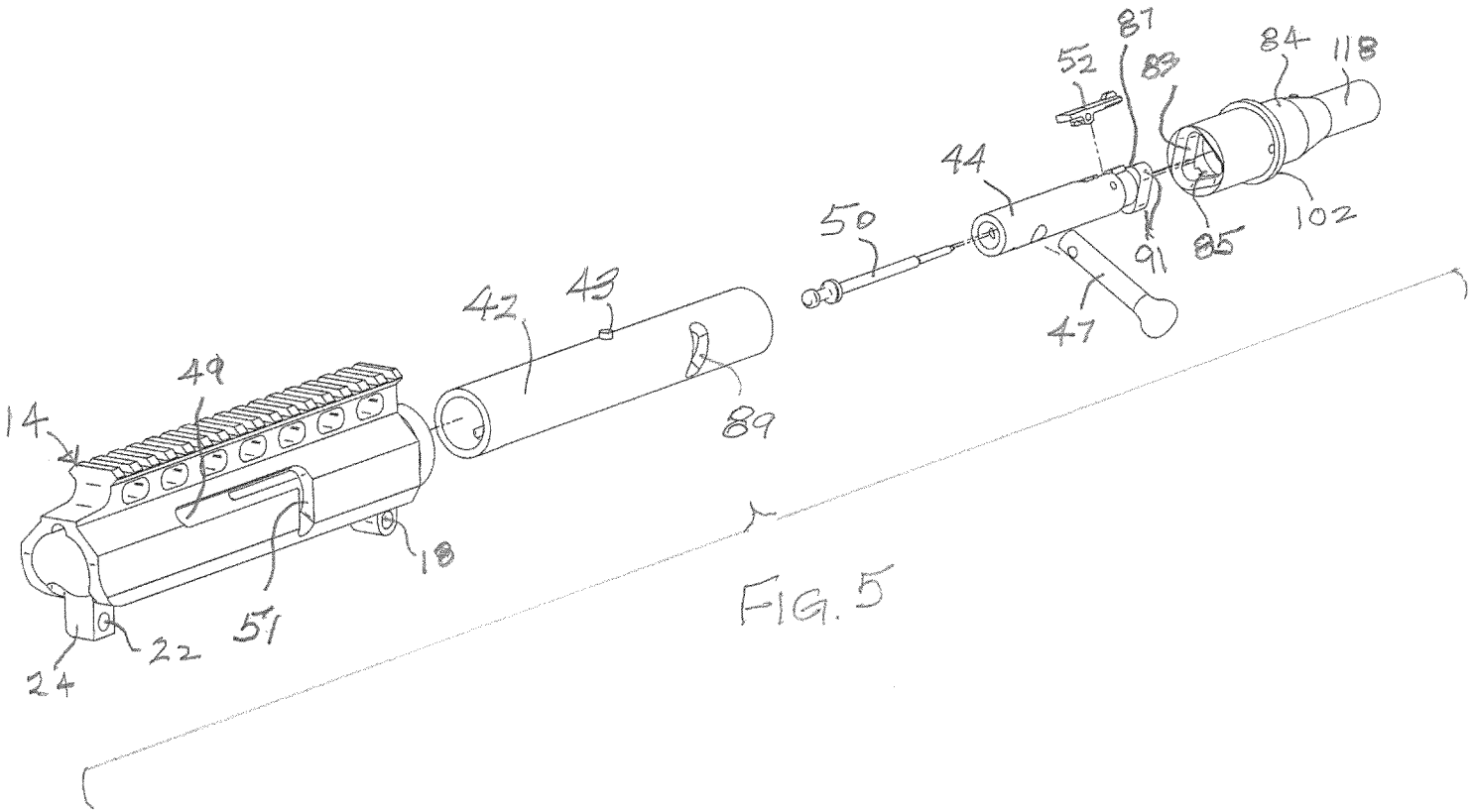
Figure 6:
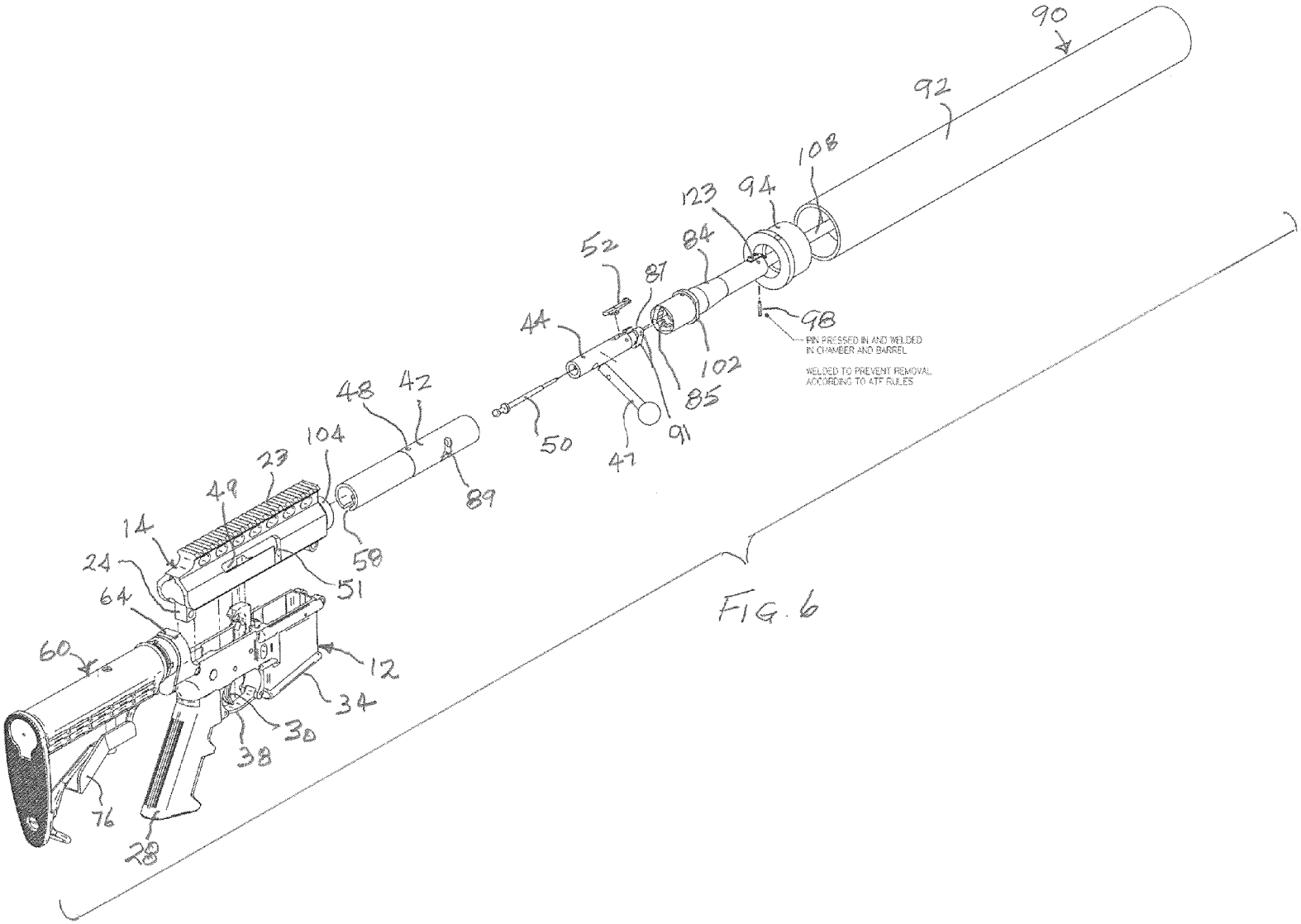

The bolt carrier 42 defines a downwardly facing elongate slot 58, as shown in FIGS. 4 and 6, through which the hammer 32 of the lower receiver moves as the hammer is retracted by manual actuation of the bolt member by operation of the bolt lever or is released by actuation of the trigger mechanism 31. A bolt actuating lever 47, shown in FIGS. 5 and 6 extends laterally from the bolt member 44 and is moveable within an elongate bolt actuation guide slot 49 and a laterally oriented guide slot 51 of the upper receiver for linear and rotational movement of the bolt member.

An adjustable butt-stock mechanism is shown generally at 60 and has a tubular adjustment member 62 that is mounted to the mount ring 64 of the lower receiver 12 and defines an elongate adjustment bar 66. A plurality of spaced adjustment openings 68 are defined by the adjustment bar and are selectively engaged by an adjustment pin 70 that is mounted within a butt-stock body 72. The adjustment pin is urged into a selected adjustment opening by a spring member 74 for locking of the butt-stock. An adjustment pin actuator 76 is retained by a head 78 of the adjustment pin 70 and is manually moved to cause unlocking movement of the adjustment pin, thus permitting selective positioning of the butt-stock body 72 relative to the tubular adjustment member 62 and the elongate adjustment bar 66 to suit the physical anatomy and other needs and desires of the user.

For arrow firing activity, a blank cartridge 80 is positioned within the cartridge chamber 82 of a cartridge receiving member 84. The blank cartridge 80 may be in the form of a rim-fire cartridge or a center-fire cartridge, having metal cartridge cases, or may have the form of a caseless gas generation cartridge of any suitable character. The cartridge is fired by the force of the firing pin 50 when struck by the rotating hammer 32 after the hammer has been released by the trigger mechanism and is rotated by a hammer spring to strike the rear end portion of the firing pin 50. As cartridge gas is discharged from the blank cartridge the cartridge case the expanding gas serves as the propellent to discharge an arrow or bolt the bolt forwardly, as will be explained in greater detail below. A bullet stop 86 is positioned within the gas passage 88 of the cartridge receiving member 84 to ensure that a cartridge having a forwardly projecting bullet cannot be loaded into the cartridge chamber.

The cartridge receiving member 84 defines a generally triangular bolt locking receptacle 85 and a plurality of angularly spaced internal bolt locking lugs 83 that permit linear insertion and locking rotation of a generally triangular locking head portion 87 of the bolt member 44. As a gas generation cartridge is fed into the cartridge chamber 82 of the cartridge receiving member 84 the bolt member is moved linearly such that its triangular locking head 87 moves into the bolt locking receptacle 85, the bolt member being guided by movement of the bolt actuating lever within the elongate internal guide slot 49 of the upper receiver.

The generally triangular locking head of the bolt member defines a plurality of external locking lugs, typically three angularly spaced locking lugs 91, that are adapted for locking engagement with the internal locking lugs of the bolt locking receptacle 85. After the triangular locking head has been manually moved forwardly to its full extent, the bolt member and its generally triangular locking head is rotated by movement of the bolt actuation lever 47 within the lateral guide slot 51 of the upper receiver 14. This movement causes rotation of the bolt member and its bolt head and moves the external locking lugs 91 of the bolt head into bolt locking engagement with the internal locking lugs 83 that are defined by the generally triangular internal geometry of the bolt locking receptacle 85. Unlocking and retraction of the bolt member is accomplished by reversing the closing and locking movement of the bolt member 44 as described above. The bolt carrier member 42 is intended to be moved linearly but not rotationally by bolt actuating movement of the bolt actuation lever 47.

To prevent rotational movement of the bolt carrier, the bolt carrier defines a substantially arcuate laterally oriented slot 89 through which the bolt actuating lever 47 extends. As the bolt member is rotated by manual movement of its bolt actuating lever, the lever is moveable within the arcuate slot 89 of the bolt carrier, so that the bolt carrier member is not rotated. When the bolt actuating lever 47 is moved linearly and is guided by the elongate guide slot 49, the bolt carrier is linearly moveable along with the bolt member. However, this linear movement of the bolt carrier member is limited by contact of the angulated forward end portion of the bolt carrier member 42 with a corresponding angulated shoulder surface that is defined by the rear portion of the cartridge receiving member 84 if the bolt carrier member is moved forwardly to its full extent.

For cartridge feeding into the cartridge chamber 82 of the cartridge receiving member 84 a magazine containing cartridges will be inserted into the cartridge receptacle 34 of the lower receiver. After the bolt member has been manually retracted to extract a spent cartridge from the cartridge chamber and cause its ejection through an ejection port 88, preferably located on the left side of the upper receiver, manually actuated forward movement of the bolt and bolt carrier will cause the uppermost cartridge of the magazine to be stripped from the magazine and conveyed into the cartridge chamber. At this point the cartridge will be ready for firing, but first an arrow, dart, bolt or the like must be positioned for projection by the energy of the cartridge gas.

A barrel assembly, shown generally at 90, comprises a tubular barrel member 92 having its rear end portion secured to a barrel retainer nut 94 by means of a threaded connection 96. A locking pin 98 is extended through matching holes of the barrel and barrel nut and is then welded or otherwise secured in place to prevent the barrel member from becoming inadvertently separated from the barrel nut. The barrel nut 94 defines an internal retainer shoulder 100 that establishes retaining engagement with an annular retainer flange 102 of the cartridge receiving member 84, thus securing the cartridge receiving member in positive retaining engagement with the barrel mount 104 of the upper receiver 14. An alignment member 106, such as an alignment pin, is provided on the cartridge receiving member 84 and is received by an alignment slot of the barrel mount 104 to ensure proper alignment and prevent rotational movement of the cartridge receiving member relative to the barrel mount of the upper receiver.

For support of an arrow 108, the barrel 92 defines a large diameter internal chamber 110 that is sufficiently large diameter to contain the fletching 112 and arrow head 114 of the arrow, without binding. The barrel 92 is of sufficient length to accommodate the entire length of the arrow and its shaft 115 such that the point of the arrow is located substantially at the forward opening 116 of the barrel and the hammer is retained by the trigger mechanism at its cocked position. This safety feature is common to most AR-15 type firearms.

The forward end portion 118 of the cartridge receiving member 84 defines an arrow nock receptacle 120 that receives the rear or nock portion of the arrow shaft 115. Transversely oriented pin members 122 are positioned to engage the slot that is typically present at the nock portion of an arrow for secure support of the rear portion of the arrow within the internal chamber 110 of the barrel. It should be borne in mind that the term "nock", as used herein, can mean the rear portion of an arrow shaft, whether or not it is provided with a notch for receiving the string of a bow. The pressure of cartridge gas acts on the rear portion of the arrow shaft within a nock receptacle to force the arrow shaft from the nock receptacle and propel the arrow forwardly from the arrow chamber of the barrel in flight toward an intended target. An arrow retainer member 123 is mounted to the cartridge receiving member and serves to engage the nock of an arrow that is located within the arrow receiving barrel and to releasably secure the nock of the arrow within the arrow nock receptacle 120 of the cartridge receiving member 84.

With a blank cartridge present within the cartridge chamber 82 of the cartridge receiving member 84 and with the hammer 32 retained at its cocked position by the trigger mechanism, and with the safety off, and an arrow present within the internal chamber of the barrel and engaged within the arrow nock receptacle 120, the gun is fired by manual movement of the trigger 30. This trigger movement releases the hammer 32 which is driven rotationally by a hammer spring, causing the hammer to strike the firing pin 50 and drive the forward end of the firing pin against the base portion of the cartridge, igniting the cartridge primer and igniting a powder charge of the cartridge. Combustion of the powder charge causes generation of combustion gas or cartridge gas, which acts on all of the rearwardly facing surfaces of the arrow, including the rear face of the arrow head of the arrow, thus driving the arrow forwardly. The fletching of the arrow will have light engagement with the internal cylindrical surface 93 of the barrel member 92 thus keeping the arrow essentially centered within the internal chamber of the barrel and guiding the arrow straight during the initial portion of its flight through the barrel and toward a target.

After having fired an arrow in this manner, the user of the arrow gun will grasp the bolt actuating lever and move it upwardly within the transversely oriented guide slot 89, thus rotating the bolt member and also rotating the generally triangular bolt head to its unlocked position. The user will then retract the bolt member by moving the bolt actuating lever linearly to the rear within the elongated guide slot 49 of the upper receiver. This linear movement causes the extractor of the bolt member to extract the spent cartridge case from the cartridge chamber and move it rearwardly. This rearward movement of the bolt member also causes the spent cartridge case to contact an ejector which causes lateral ejecting movement of the spent cartridge through a cartridge ejection slot 88 that is preferably located on the left side of the upper receiver.

Another arrow can then be manually inserted into the internal chamber 110 of the barrel where its rear or nock portion is engaged within the nock receptacle 120 to ready the arrow for firing. The bolt actuating lever can then be actuated forwardly, causing the bolt head to strip a fresh blank cartridge from the cartridge magazine and feed it into the cartridge chamber 82 of the cartridge receiving member 84, thus repeating the arrow loading and firing procedure.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A cartridge gas energized arrow gun, comprising:

upper and lower receiver members;

a barrel mount being defined by said upper receiver member;

a cartridge receiving member having a cartridge chamber and being disposed in engagement with said barrel mount, said cartridge receiving member defining a bolt locking receptacle;

a barrel configured to support an arrow, the barrel having a barrel retainer member being secured to said barrel mount and securing said cartridge receiving member to said upper receiver member;

a bolt and bolt carrier assembly configured to be moveable within said upper receiver member, said bolt having a bolt head having selective locking and release positions with said bolt locking receptacle;

a manual actuator being connected with said bolt and being configured for manual operation for selective movement of said bolt to said locking and release positions and for locking a blank cartridge within said cartridge chamber, firing the blank cartridge and extracting a spent cartridge case from said cartridge chamber;

said barrel retainer member of said arrow supporting barrel being a barrel nut having threaded engagement with said upper receiver member and having retaining engagement with said cartridge receiving member and securing said cartridge receiving member in substantially immoveable relation with said upper receiver member;

said cartridge receiving member defining a gas passage in communication with said cartridge chamber and conducting cartridge gas from a blank cartridge within said cartridge chamber to said arrow supporting barrel to propel an arrow from said arrow supporting barrel;

said bolt locking receptacle of said cartridge receiving member being of generally triangular configuration and defining a plurality of internal locking lugs; and said bolt head being of generally triangular configuration and having a plurality of external locking lugs being moveable by said bolt into locking engagement with said internal locking lugs and locking said bolt to said cartridge receiving member to permit firing of a blank cartridge within said cartridge chamber.

2. The cartridge gas energized arrow gun of claim 1, comprising:

said upper and lower receiver members being generally in the form of the upper and lower receivers of a conventional AR-15 rifle.

3. The cartridge gas energized arrow gun of claim 1, comprising:

said upper receiver member defining a bolt actuation guide slot on one side of said upper receiver member, said bolt actuation guide slot having an elongate guide slot portion and a laterally oriented guide slot portion; and said manual actuator being a bolt actuation lever extending from said bolt through said bolt actuation guide slot and being manually moved for linear and rotational movement of said bolt during blank cartridge handling.

4. The cartridge gas energized arrow gun of claim 3, comprising:

said upper receiver member defining a cartridge ejection port located on a side portion of said upper receiver member opposite said bolt actuation guide slot.

5. The cartridge gas energized arrow gun of claim 1, comprising:

said arrow supporting barrel defining a arrow chamber within which a arrow is located prior to firing of said blank ammunition cartridge;

said cartridge receiving member defining an arrow nock receptacle located within said arrow chamber with the nock of an arrow shaft being secured within said arrow nock; and said gas passage of said cartridge receiving member being in communication with said nock receptacle.

6. The cartridge gas energized arrow gun of claim 1, comprising:

said upper receiver member defining a bolt actuation guide slot on one side of said upper receiver member, said bolt actuation guide slot having an elongate guide slot portion and a laterally oriented guide slot portion;

said bolt and bolt carrier assembly having a generally tubular bolt carrier within which said bolt is located for linear and rotary movement, said generally tubular bolt carrier defining a bolt actuator slot; and said bolt actuator lever extending from said bolt through said bolt actuator slot and through said bolt actuation guide slot for manual linear and rotational movement by a user.

7. A cartridge gas energized arrow gun, comprising:

upper and lower receiver members being connected in assembly;

an externally threaded barrel mount being defined by said upper receiver member;

a cartridge receiving member having an internal cartridge chamber and having engagement with said externally threaded barrel mount, said cartridge receiving member defining an internal bolt locking receptacle having a plurality of internal locking lugs;

a barrel configured to support an arrow, the barrel having a barrel retainer nut being threaded to said externally threaded barrel mount and securing said cartridge receiving member in substantially immoveable relation with said upper receiver member;

a bolt and bolt carrier assembly configured to be moveable within said upper receiver member, said bolt having a bolt head having external locking lugs configured for selective locking and release positions with said internal locking lugs of said bolt locking receptacle; and a manual actuator being connected with said bolt and being configured for manual operation for selective movement of said bolt to said locking and release positions and for locking a blank cartridge within said cartridge chamber, firing the blank cartridge and extracting a spent cartridge case from said cartridge chamber.

8. The cartridge gas energized arrow gun of claim 7, comprising:

said upper and lower receiver members being generally in the form of the upper and lower receivers of a conventional AR-15 rifle.

9. The cartridge gas energized arrow gun of claim 7, comprising:

said upper receiver member defining a bolt actuation guide slot on one side of said upper receiver member having an elongate guide slot portion and a laterally oriented guide slot portion; and said manual actuator being a bolt actuation lever extending from said bolt through said bolt actuation guide slot and being manually moved for linear and rotational movement of said bolt during blank cartridge handling.

10. The cartridge gas energized arrow gun of claim 7, comprising:

said upper receiver member defining a cartridge ejection port located on a side portion of said upper receiver member opposite said bolt actuation guide slot.

11. The cartridge gas energized arrow gun of claim 7, comprising:

said barrel nut having threaded engagement with said externally threaded barrel mount of said upper receiver member and having retaining engagement with said cartridge receiving member and securing said cartridge receiving member in substantially immoveable assembly with said upper receiver member; and said cartridge receiving member defining a gas passage in communication with said cartridge chamber and conducting cartridge gas from a blank cartridge within said cartridge chamber to said arrow supporting barrel to propel an arrow from said arrow supporting barrel.

12. The cartridge gas energized arrow gun of claim 11, comprising:

said arrow supporting barrel defining a arrow chamber within which a arrow is located prior to firing of said blank ammunition cartridge;

said cartridge receiving member defining an arrow nock receptacle located within said arrow chamber with the nock of an arrow shaft being secured within said arrow nock; and said gas passage of said cartridge receiving member being in communication with said nock receptacle.

13. The cartridge gas energized arrow gun of claim 7, comprising:

said upper receiver member defining a bolt actuation guide slot on one side of said upper receiver member, said bolt actuation guide slot having an elongate guide slot portion and a laterally oriented guide slot portion, said upper receiver member further defining an elongate internal bolt carrier guide slot;

said bolt and bolt carrier assembly having a generally tubular bolt carrier within which said bolt is located for linear and rotary movement, said generally tubular bolt carrier defining a bolt actuator slot, said generally tubular bolt carrier having an externally projecting guide member disposed for linear guiding movement within said elongate internal bolt carrier guide slot;

said bolt actuator lever extending from said bolt through said bolt actuator slot and through said bolt actuation guide slot for manual linear and rotational movement by a user;

said bolt locking receptacle of said cartridge receiving member being of generally triangular configuration and defining a plurality of internal locking lugs; and said bolt head being of generally triangular configuration and having a plurality of external locking lugs being moveable by said bolt into locking engagement with said internal locking lugs and locking said bolt to said cartridge receiving member to permit firing of a blank cartridge within said cartridge chamber.

* * * * *